US005339883A

United States Patent [19]

Colson et al.

[11] Patent Number: 5,339,883

[45] Date of Patent: Aug. 23, 1994

[54] COVERING ASSEMBLY FOR ARCHITECTURAL OPENINGS

[75] Inventors: Wendell B. Colson, Boulder; James M. Anthony, Denver; Brad H. Oberg, Littleton, all of Colo.; Cornelis M. Jansen, Woudrichem, Netherlands

[73] Assignee: Hunter Douglas Inc., Upper Saddle River, N.J.

[21] Appl. No.: 963,359

[22] Filed: Oct. 20, 1992

Related U.S. Application Data

[63] Continuation-in-part of Ser. No. 810,331, Dec. 19, 1991.

[51] Int. Cl.[5] ..... E06B 3/94

[52] U.S. Cl. ..... 160/84.1 D; 160/176.1

[58] Field of Search ..... 160/84.1 C, 84.1 D, 160/84.1 E, 166.1, 176.1, 177, 168.1, 172, 345, 900

[56] References Cited

U.S. PATENT DOCUMENTS

| | | | |
|---|---|---|---|
| 286,027 | 10/1883 | Lobdell . | |
| 718,992 | 1/1903 | Emery . | |
| 1,958,695 | 5/1934 | Claus . | |
| 2,029,675 | 2/1936 | Schlamp . | |
| 2,140,049 | 12/1938 | Grauel . | |
| 2,620,850 | 12/1952 | Janowski . | |
| 2,688,356 | 9/1954 | Conti . | |
| 2,822,840 | 2/1958 | Reynolds . | |
| 2,834,412 | 5/1958 | Velke . | |
| 2,865,446 | 12/1958 | Cole . | |
| 3,299,943 | 1/1967 | Poe | 160/176.1 |
| 3,371,702 | 3/1968 | Keegan et al. . | |
| 3,384,519 | 5/1968 | Froget . | |
| 3,421,276 | 1/1969 | LaBarge . | |
| 3,509,934 | 5/1970 | Smart . | |

(List continued on next page.)

FOREIGN PATENT DOCUMENTS

| | | |
|---|---|---|
| 0220074 | 4/1987 | European Pat. Off. . |
| 122088 | 4/1900 | Fed. Rep. of Germany . |
| 382758 | 5/1922 | Fed. Rep. of Germany . |
| 1241361 | 5/1967 | Fed. Rep. of Germany . |
| 8906284 | 9/1989 | Fed. Rep. of Germany . |
| 319458 | 11/1902 | France . |
| 847779 | 10/1939 | France . |
| 1309194 | 10/1962 | France . |
| 1321456 | 2/1963 | France . |
| 1373515 | 8/1964 | France . |
| 6508988 | 1/1967 | Netherlands . |
| 7805464 | 10/1979 | Netherlands . |
| 951484 | 3/1964 | United Kingdom . |
| 1036126 | 7/1966 | United Kingdom . |
| 1116934 | 6/1968 | United Kingdom . |

*Primary Examiner*—David M. Purol
*Attorney, Agent, or Firm*—Gary M. Polumbus

[57] ABSTRACT

A covering for an architectural opening such as a window or door is in the form of a vertically oriented fabric assembly having front and rear sheer fabrics interconnected by vertically extending vanes. The vanes can be tilted through a series of carriers mounted on a track rail from which the covering is suspended in order to adjust the spacing between the fabrics between open and closed positions and adjust the light transmitting characteristics of the covering. The covering can be extended across the opening by separating the carriers on the track rail and can be contracted by stacking the carriers toward one end of the track rail. A unique design of carrier allows the covering to fold on itself in the contracted state, in the manner of a conventional drape.

21 Claims, 5 Drawing Sheets

U.S PATENT DOCUEMENTS 3,661,665 5/1972 Froget .
3,701,376 10/1972 Froget .
3,708,009 1/1973 Viol .
3,783,931 1/1974 Assael .
3,844,330 10/1974 Hyman ..... 160/84.1 C X
3,851,699 12/1974 Shapiro ..... 160/168.1
3,860,056 1/1975 Bruneau ..... 160/176.1
3,946,789 3/1976 Tolle ..... 160/84.1 C X
4,182,088 1/1980 Ball .
4,202,395 5/1980 Heck et al. .
4,344,474 8/1982 Berman .
4,434,834 3/1984 Ennes .
4,473,101 9/1984 Langeler .
4,519,434 5/1985 Forquer .
4,647,488 3/1987 Schnebly .
4,673,018 6/1987 Judkins .
4,687,038 8/1987 Clemente .
4,694,543 9/1987 Conley .
4,732,630 3/1988 Schnebly .
4,799,299 1/1989 Campbell .
4,858,668 8/1989 Toti ..... 160/84.1 C
4,862,941 9/1989 Colson .
4,885,190 12/1989 Schnebly .
4,912,900 4/1990 Yeamans .
4,915,153 4/1990 Toti ..... 160/345 X
5,002,628 3/1991 Schnebly .
5,070,924 12/1991 Bateman .

D
14
14
14
74
C
12
74'
A
A
A
B
B
B
16
16
16
10

COVERING ASSEMBLY FOR ARCHITECTURAL OPENINGS

This application is a continuation-in-part of U.S. patent application Ser. No. 07/810,331, filed Dec. 19, 1991.

FIELD OF THE INVENTION

The present invention relates to a covering assembly particularly for windows, doors and other architectural openings.

BACKGROUND TO THE INVENTION

There are many known forms of covering assembly for windows, doors and the like including curtains, roller blinds, venetian blinds, drapery and the like. Recently there has been proposed a window covering assembly which includes a first and second generally parallel spaced apart longitudinally extending sheer fabrics having a plurality of longitudinally spaced generally parallel transversely extending vanes fixedly secured to the first and second sheer fabrics to extend therebetween.

The sheer fabrics are often constructed of a translucent or transparent material and may be in the form of woven or knitted fabrics or non-woven fabrics or indeed may simply be sheets of plastics material. The vanes are usually opaque or semi-opaque and by adjusting the relative positions of the sheer fabrics, the vanes can be caused to tilt relative to the sheer fabrics rather in the manner of the slats of a horizontal or vertical blind. When the vanes extend horizontally, conventionally such assemblies have a bottom rail and the sheer fabrics are supported on a tilt roll which can also be used as a wind up roll. When the vanes extend vertically, conventionally such assemblies have a head rail for opening and closing the assembly and for tilting the vanes when the assembly is in the closed position covering the opening.

SUMMARY OF THE INVENTION

It is a primary object of the present invention to provide a novel covering assembly that will have all of the attributes and advantages of a vertical blind while having all the attributes and advantages of drapery.

The foregoing is accomplished by providing a vertically oriented fabric assembly with front and rear sheers and vertically disposed vanes extending therebetween. A unique carrier system supports the front and rear sheers to enable them to shift from a maximum light admitting orientation to a minimum light admitting orientation by rotating the vanes about vertical axes. The carrier system also enables the panels of the assembly (a vane and the juxtaposed portions of the front and rear sheers) to collapse and fold up upon themselves much like conventional drapery.

Other and further objects and advantages of the invention will be fully understood and appreciated from the following detailed description of preferred embodiments of the assembly of the invention with reference being made to the accompanying drawings.

DETAILED DESCRIPTION OF PREFERRED EMBODIMENT

Figure 1:
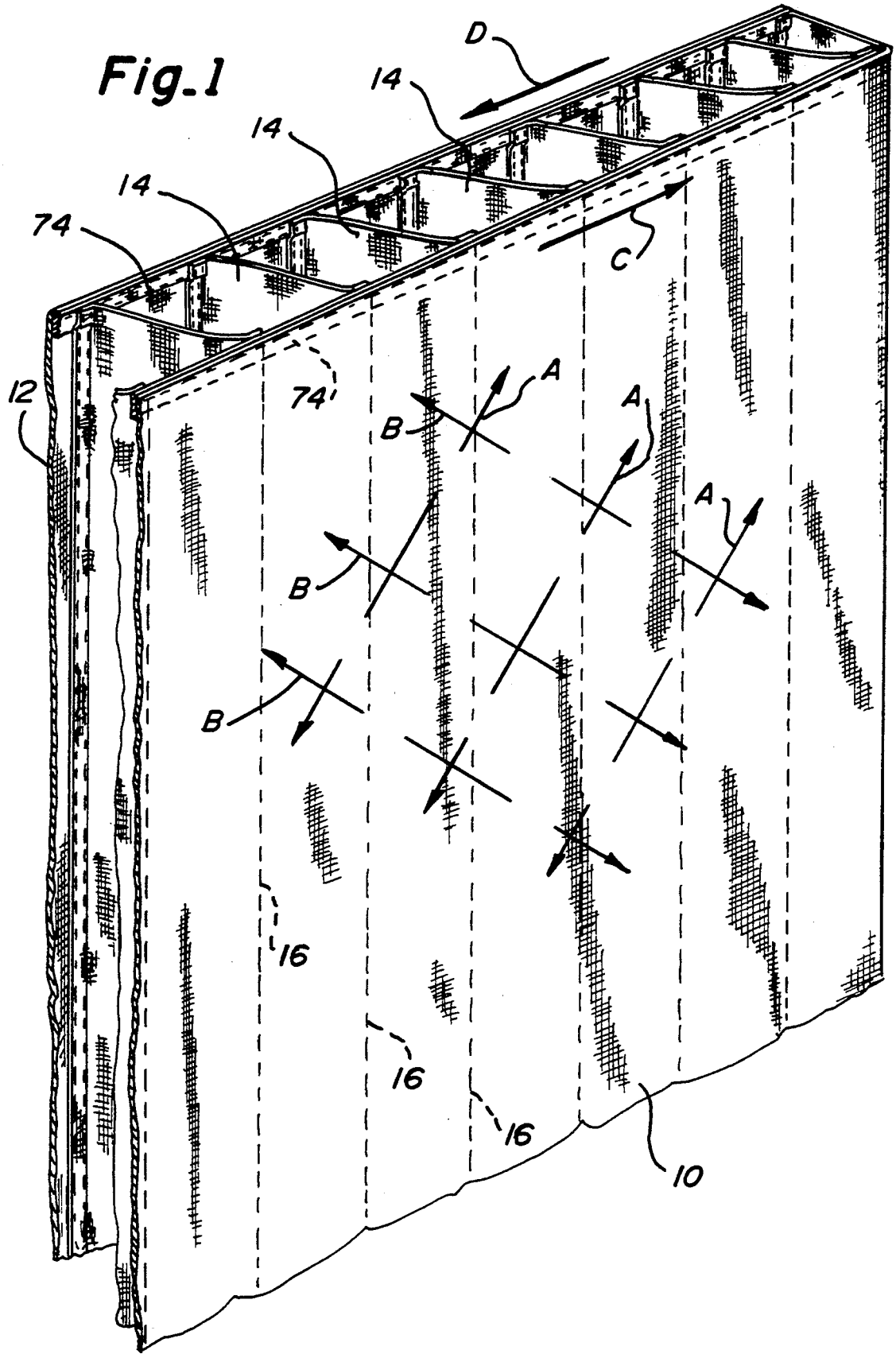
FIG. 1 is a schematic perspective view of the fabric assembly used in the present invention.

A fabric light control window covering (FIG. 1) comprises first (front) and second (rear) parallel sheer fabric sides or faces 10, 12 and a plurality of opaque or semi-opaque vanes 14 extending between the sheer fabric sides with the vanes being angularly controllable by relative movement of the sheer fabric sides.

The window covering has a neat and uniform construction and outer appearance in all degrees of light control. The light control vanes are bonded to the sheer fabric utilizing linear application of a suitable adhesive along straight lines 16 (bond lines) and, thus, a high degree of controllability of the adhesive application process and bonding of the vane is obtained. The precisely uniform construction improves the operation of the covering by preventing warps or distortions from developing over its life.

The covering operates with a high degree of repeatability, that is, always returns to the same appearance when closed. Thus, a feature of the present invention is attachment of the vanes to the sheer fabric sides such that the vanes tend to bias the window covering toward the minimum light admitting position. A further feature of the invention in this respect is a novel heat setting of the three layers together in order to provide a uniform and wrinkle-free shade at any temperature in subsequent use. These features allow the window covering to maintain its original shape and appearance even in the presence of temperature extremes encountered in a window environment.

Accordingly, a fabric light control (door or window) covering according to the present invention comprises a first sheer fabric sheet, a second sheer fabric sheet disposed parallel to the first sheet, and a plurality of relatively opaque fabric strips adhesively bonded transversely between the sheet fabrics. Each strip has an edge portion bonded to the first sheet and an opposite edge portion bonded to the second sheet in a manner tending to bias the first and second sheets together. The (window) architectural opening covering according to the present invention is adjustable between a closed position, minimum or no light entry, preferably no see through, and an open position, maximum light entry. The closed position is characterized by a central portion of the fabric strips being substantially parallel to the first and second sheer fabric sheets with the strips themselves being substantially planar; in this position, the front and rear sheets with vanes sandwiched therebetween are collapsed together. The open position is characterized by the central portion of the fabric strips being substantially perpendicular to the first and second fabric sheets and to the bonded edge portions of the strips themselves; in this position the front and rear sheets are spaced apart the maximum distance. Also, characteristic of this position is that portions of the strips between the bonded edge portions and central portions form smoothly curving surfaces which are free of creases or sharp fold. In an alternative embodiment, the central portions of the fabric strips are substantially flat and longitudinally extending hinge or flex points are provided parallel to the bonded edge portions. The covering is adjustable between the two positions by relatively shifting the front and rear sheets 10, 12. This action moves them closer and closer together until they are collapsed together. In intermediate positions the light control is achieved.

When the (window) covering material is in a fully open, light admitting position, each vane has a central portion which is substantially perpendicular to first and second sheer fabrics. Edge portions of the vane, which are bonded to the sheer fabrics, are connected to the central portion by transition portions having a smoothly curving shape. The adhesive bonding of the vanes allows formation without creases or sharp folds. The smoothly curved nature of these transition portions, in the fully open position, allows the vane to retain its resiliency and thus tends to bias the sheer fabrics into a closed or drawn together position. This ensures that the window covering does not lose its shape over time from repeated opening and closing. Furthermore, creases along the vanes can develop into failure points due to repeated bending inherent in the opening and closing of the window covering.

Moire effect must be avoided in the (window) covering. Although sheer woven fabrics having small interstices between the fibers provide a pleasant and desirable appearance for the first (front) and second (rear) sheer fabrics, when the same or very similar material of this type is used for the first and second sheer fabrics, a moire pattern is created by the fabrics when viewed in overlaying relationship due to light interference effects. This moire effect is eliminated in the present invention by providing for the first and second sheers woven and preferably knit fabrics of materials having differently sized, shaped and/or oriented interstices. According to the present invention, the moire effect is also avoided by using a nonwoven sheer material as one or both of the first and second fabrics or by using a transparent plastic material as one or both of the first and second fabrics.

To avoid the undesirable moire effect when the first and second sheers of woven or knit material are viewed in overlaying relation in the window covering of the present invention, the first and second sheers must have different appearances when the sheer panels are viewed along an axis perpendicular to the plane of the first sheer and perpendicular to the plane of the second sheer. The required difference in appearance between the first sheer and the second sheer can be achieved in several different ways.

The first or front sheer 10 can be a woven or knit fabric having interstices of one shape and the second or rear sheer 12 can be a woven or knit material having interstices of a second shape. For example, a woven fabric employing fibers forming small square interstices is used as the second sheer and a material is used for the first sheer that may have fibers forming interstices which are smaller, the same size or larger than those of the second sheer fabric. However, the threads of the first sheer run at approximately 45° angle (30°–60° angle) with respect to the thread of the second sheer. For example, the threads of the first sheer run diagonally, forming diamonds, whereas the threads of the second sheer run orthogonally forming squares. With this relationship between first and second sheers, the appearance of a moire pattern can be avoided. Also, as described in more detail below, it is desirable that both sheer fabrics should have dimensional stability on the bias or diagonal.

In another embodiment, the first sheer can be a woven or knit fabric having interstices of one shape and size and the second sheer can be a woven or knit fabric having interstices of the same shape as the first sheer fabric but of a different size. In this second embodiment, the moire pattern may be avoided by providing a second sheer which has interstices which are smaller than those of first sheer without regard to the relative orientation or shape of the interstices. This also prevents the occurrence of interference effects leading to a moire effect. In practice, the first and second sheers are selected so that the width of the interstices of the first sheer is far greater than the width of the interstices of the second sheer, thereby avoiding the moire effect. For example, the threads of the second sheer are so small so that they cannot discern as individual threads, while the threads of the first sheer are larger or vice versa.

Also, moire effect can be eliminated by using thread spacing so small that one's eye cannot discern individual threads for the second sheer and use with a fabric for the first sheer in which has a larger thread spacing. It is also possible to use the same woven or knitted fabric for both the first and second sheers provided that the fabric is oriented differently in the two sheers in order to provide the required difference in appearance. For example, the fabric of second sheer can have square interstices, and the same fabric having square interstices can be used as the fabric of the first sheet by changing the orientation of the fabric by 45° to provide the diamond shaped interstices of the first sheer. When the same fabric is used for both the first and second sheers, the fabric for one of the sheets is cut on the bias so that the orientation of the interstices of that fabric is changed by an angular amount, e.g. roughly 45°, 60° or 90°, sufficient to provide the required difference in appearance when the first and second sheers are viewed along an axis perpendicular to the plane of both.

It is also possible to avoid the moire effect and provide the required difference in appearance by using a nonwoven sheer material, such as a plastic material, for one of the sheers and a woven or knit material for the other of the sheers of the covering. Alternatively, nonwoven sheer materials, such as the same or different plastic materials, can be used for both the first and second sheers. A transparent plastic material can also be used as the first and/or second fabric. The use of a transparent material as at least one of the first and second fabrics also avoids the moire effect.

To achieve the gently curved structure of the vanes, the vane material must have a certain degree of softness. As a general principle, the wider the vanes 10, the stiffer the vane material can be. However, since a broad range of vane widths may be employed in window coverings in accordance with the present invention, it is difficult to precisely define an acceptable softness or stiffness range for the vane material.

A simple and effective physical test has been devised to determine whether a particular fabric is suitable for vanes having a specific vane width. The fabric being tested is allowed to hang over the edge of a table such that the distance from the edge of the fabric to the table top equals the desired vane width. If this length of fabric hangs substantially vertically, then it has sufficient softness for a vane of that vane width. For example, if a fabric is being tested for use as a 2" wide vane, the edge of the fabric is extended 2" beyond the edge of the table. If the extended 2" of the fabric hangs substantially vertically from the table edge, it is suitable for use as a 2" wide vane material. If the extended 2" of the fabric does not hang substantially vertically, the fabric is too stiff to produce 2" wide vanes having the gently curved appearance.

Stiffer fabrics, i.e., those which do not hang substantially vertically over a table edge at the length of the desired vane width, can also be used as the vane material. However, if a stiffer fabric is used for the vanes, longitudinally extending hinge or flex points must be provided along the edges of the vanes. The use of a stiffer fabric provided with hinge points produces a covering having a somewhat different appearance. In these circumstances, vanes have a straighter appearance and have a sharp bend at the hinge points, rather than a gently curing portion. The hinge points are provided by score-compressing a stiff vane material, parallel to the longitudinal edges of the vane material. The score-compressed lines formed in the stiff vane material are spaced apart from the longitudinal edge of the vane material a distance sufficient to allow adhesive lines to be applied to the vane material between the longitudinal edge of the vane material and the score-compressed line.

A structure can also be produced using a relatively soft vane material, if desired. In this embodiment, a stiffening agent is printed on the vane material in the central portion thereof to provide flatter vanes. The longitudinal edges of the vane material are left free of stiffening agent and the required hinge points are formed at the longitudinally extending edges of the printed on stiffening agent. The adhesive lines are applied to the longitudinal edges of the vane material, which longitudinal edges have been left free of stiffening agent.

According to another embodiment of the present invention, the vanes are formed of a black-out laminate material to maximize the room darkening effect of the window covering when the vane are oriented in the closed position. A suitable black-out laminate material is a three ply laminate comprising a polyester film such as MYLAR sandwiched between two layers of a spun bonded or spun laced polyester nonwoven material. Such a three ply laminate has, by virtue of its construction, a greater stiffness than most single ply materials. Accordingly, score-compressed hinge points could be provided in the black-out laminate vane material if necessary.

Alternatively, to produce a covering of the present invention having a maximized room darkening effect, only a stiffened central portion of the vanes is formed from a black-out laminate material. The longitudinal edges of the vanes are left free of the black-out laminate to provide the required hinge points and flexibility along the edges of the vanes. When the black-out laminate is provided only on the central portion of the vanes, it is desirable to space the vanes closes together than described above in order to ensure that the black-out laminated central portions overlap when the covering is closed, for maximum room darkening effect. For example, for a 2.5 inch wide vane with a $1\frac{1}{2}$ inch wide black-out laminated central portion, the overlap of the vanes is preferable about $\frac{1}{2}$ inch.

Another possible vane material is vinyl or a laminate of a nonwoven material and a vinyl material. Generally, vinyl materials and laminates of nonwoven material and a vinyl material provide an increased room darkening effect but are soft enough that score-compressed hinge points are not required. Of course, score-compressed hinge points could be provided if necessary.

As discussed with respect to the first and second sheers of the covering, when two woven fabrics are viewed in an overlaying relationship, an interference pattern or moire effect can result. When a non-woven fabric is used for the vane material, the problem of a moire effect in the covering when it is closed is avoided. In some instances, however, it may be desirable to use a woven or knit material for the vane material. A basic woven material will give a moire effect because this type of material has a very ordered orthogonal surface structure. To avoid a moire effect (overlay) when the covering, having a woven or knit vane material, is in the closed position, a crepe woven materials can be used as the vane material because crepe woven materials have a much more randomly oriented surface structure. Alternatively, the surface of the woven or knit material can be altered to randomize the surface fibers, for example, by sanding, napping or calendarizing.

Coverings having first and second sheers and vanes of various colors, and combinations of colors are contemplated within the scope of the present invention. For example, to provide a more transparent covering in the open position, dark sheer material can be used for the first and second sheers because dark colors reflect less light than lighter colors. Similarly, white or light colored sheer materials provide a more translucent effect when the covering is open.

The vanes may be the same color or a different color than the first and second sheer fabrics. A problem of glue line show-through has been experienced, however, when the vane material is a dark color and the first and second sheer fabrics are of a considerably lighter color or white. To overcome the problem of a dark glue line showing through a light colored sheer material when the vane is adhesively bonded to the first or second sheer fabric of the covering, a small amount of whitener, about 0.5 to 1.0% by weight, is added to the adhesive before it is applied to the vane material. A particularly suitable whitener is titanium dioxide. The addition of this whitening pigment to the adhesive eliminates the problem of dark colored glue lines being visible in a covering wherein a dark colored vane is adhesively bonded to a lighter colored sheer fabric. Also, the addition of titanium dioxide to the glue can be a way to dull the glue lines.

With respect to the vanes, it has been unexpectedly found that by increasing the machine-direction or lengthwise tension on the material prior to and during application of a bonding composition, the machine-direction stiffness of the treated fabric is advantageously and significantly increased with only a slight increase in cross-direction stiffness of the treated fabric. The strips used for the vanes are cut from the treated fabric. A high ratio of machine-direction stiffness to cross-direction stiffness is desirable in the treated fabric, particularly when the treated fabric is to be fabricated into vanes. Depending upon the type and number of yarns in the woven textile material, the ratio of machine-direction stiffness to cross-direction stiffness for treated fabric according to this invention can range from between about 3:1 to 50:1, or more.

Increasing the machine-direction tension on the woven material while allowing neck down or letting the fabric go slack in the cross-direction causes the warp yard filaments to draw in tightly and then the applied binder composition bonds these warp yard filaments together such that the bonded filaments act as one much stiffer yarn. The lack of tension in the cross-direction allows the fill direction filaments to remain fluffy and, therefore, to not bond as easily to one another when the binder composition is applied.

In this process of treating the woven textile material to produce the treated fabric for the vanes, the fabric is treated with a low percentage (up to about 5%) by weight solids add on of a binder composition. The preferred binder composition is applied to the woven textile material in an amount of about 2% by weight solids add on.

The binder composition with which the woven textile material is treated can be any composition capable of filling the interstices in the woven textile material to bind the individual fibers. Examples of suitable types of binder compositions include elastomers which are capable of binding the individual fibers of the woven textile material and which are resistant to ultraviolet (UV) radiation and to breakdown or degradation due to other environmental factors. Especially preferred compositions are elastomeric acrylics and elastomeric urethane-type compositions. One particularly preferred composition is a latex emulsion which is a mixture of about 15 to 25% by weight of an acrylic and about 75 to 85% by weight of an elastomer. In addition, the preferred composition may include minor amounts of conventional latex emulsion additives such as a defoamer, a synthetic thickener, and the like. An especially suitable composition is a latex emulsion containing 71% by weight of the elastomer sold under the tradename V-29 by B. F. Goodrich; 27% of the acrylic binder sold under the tradename HA-16 by Rohm & Haas; 1.5% by weight of the defamer sold under the tradename Nalco 2305; and 0.5% by weight of the synthetic thickener sold under the tradename UCAR SCT-270 by Union Carbide.

The maximum spacing of the front and rear sheers is dependent on the vane width. According to the invention vane widths of 2–6 inches are used but $2\frac{1}{2}$–4 inch widths are preferred. In the best mode for carrying out the invention the maximum spacing is $2\frac{5}{8}''$ using vanes $3\frac{1}{2}''$ wide with a 3" spacing between successive vanes to achieve an appropriate vane overlap.

As referred to above, it is desirable for both sheer fabrics 10 and 12 to have dimensional stability generally in the bias or diagonal lines as indicated by the arrows A and B in FIG. 1. The reason for this is as follows.

In a window covering of this nature, the covering is opened and closed by moving the front and rear sheer fabrics 10 and 12 horizontally relative to each other, conveniently by forces which are applied to the top edges of the respective sheers by actuators, or the like yet to be described. When the covering is being closed, the sheers are moved in the horizontal directions indicated by arrows C and D. During this operation, to provide effective movement over the entire height of the covering without wrinkling of the fabric, the front sheer 10 should be dimensionally stable in the direction of arrows A and the back sheer 12 should be dimensionally stable in the direction of arrows B. Conversely, when the covering is being opened and the sheers are moved horizontally in directions opposite arrows C and D, the front sheer 10 should be dimensionally stable in the direction of arrows B and the back sheer 12 should be dimensionally stable in the direction of arrows A.

To obtain the required dimensional stability of the sheers while avoiding the moire effect, one of the sheers may have diamond shaped interstices and the other sheer may have rectangular shaped interstices with additional diagonally extending loop threads which are only microscopically detectable.

Figure 2:
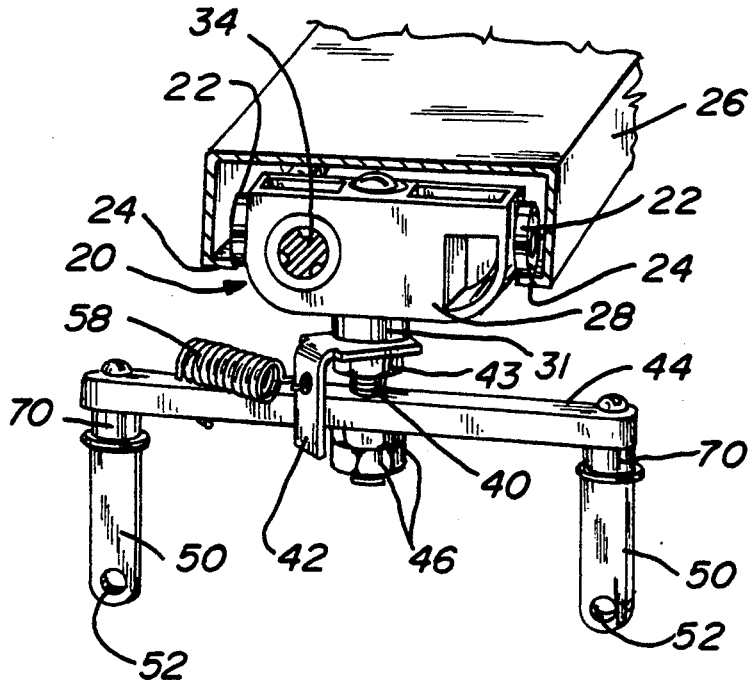
FIG. 2 is a perspective view of one of the unique carrier assemblies used for mounting the fabric assembly of FIG. 1.

The fabric light control window or door covering is to be supported from carriage assemblies 20 (FIG. 2) that have freely rotatably mounted wheels 22 that ride on tracks 24 defined by a conventional drapery track generally designated as 26. The main body 28 of the carriage is a plastic molded body in which is bearing held a worm gear 30, easily pushed into the body, and is in meshing engagement with a worm 32 journalled in body 28 and operated by a splined tilt rod 34 which extends through the worms of all the carriers. Rotation of rod 34 via a wand, cord 35 (FIG. 13), or the like drives worm 32 causing worm gear 30 to rotate. Optionally, a stop may be included to confine worm gear 30 to less than 360° rotation. All of the above is conventional and may be seen, e.g., in U.S. Pat. No. 4,648,436, which disclosure is here incorporated by reference. Spacers, not shown, are mounted to assemblies 20 in a conventional manner via a slot in body 28 and to a cord 29, spindle or the like in a conventional manner to effect the conventional drawing action to spread out the carriage assemblies 20 along the track or to gather them at one end. Alternatively, a conventional scissors arrangement can be used to replace the spacers. Furthermore, the spacer or scissors arrangement may be deleted so that the front and rear fabric define the distance between carriers when the light control covering is in its expanded condition.

A threaded shaft 40 is fixed to worm gear 30 and extends below or depends from the main body 28 via bearing projection 31 and has fixed thereon an L shaped actuator control element 42 by a nut 43 holding the horizontal leg of element 42 fixed to shaft 40. Shaft 40 extends further downwardly passing freely through an actuator arm 44 (actuator member) and has a pair of nuts 46 threaded onto its lower end to lock and establish a stop and provide height adjustment.

Arm 44 extends for a distance at least equal to the maximum opening of the covering e.g. $2\frac{5}{8}''$ and at either end is connected with a hanger or an attachment member 50 consisting of a paddle like lower end having a hole 52 defined adjacent its lower free end and an upper end that is freely pivotally mounted in the end of arm 44 by any conventional mounting means. A spring 58 is fixed at one end to the arm 44, such as by passing through hole 54 in arm 44 and being bent or crimped. The other end of spring 58 is fixed to the depending leg of actuator element 42 in a like manner. When splined tilt rod 34 is actuated and drives worm 32, worm gear 30 via element 42 and spring 58 will cause arm 44 to rotate around shaft 40.

Figure 3:
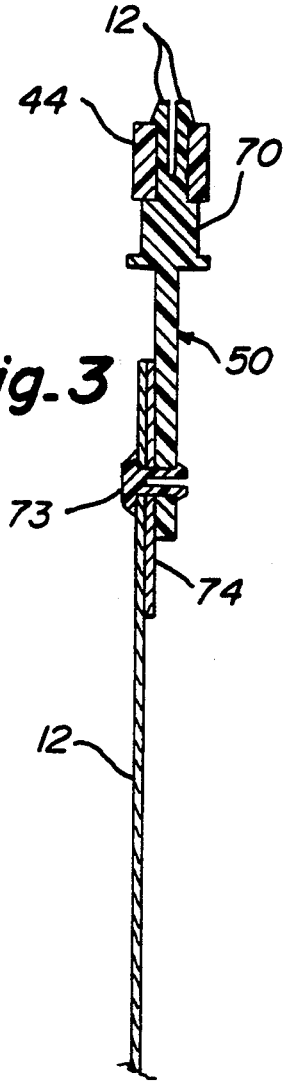
FIG. 3 is a schematic side elevation showing how a sheer is mounted on a hanger.
Figure 4:
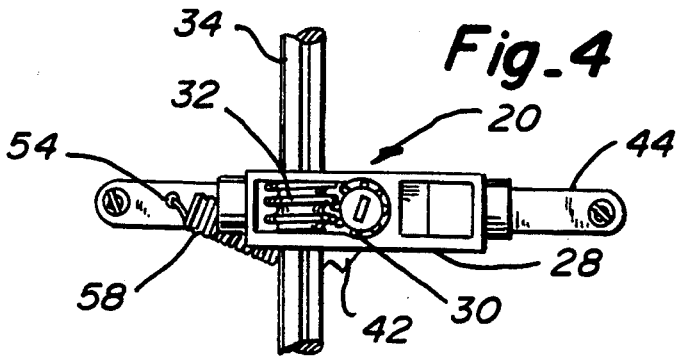
FIG. 4 is a plan view of a carrier assembly.

Hanger 50 may consist of a body 70 in the form of a T with a pair of deflectable spaced headed or barbed connectors 72 extending upwardly from the top of the cross bar of the T for insertion into the hole at the end of arm 44 as shown in FIG. 3. A hole at the lower end of the depending leg of the T cooperates with a pin 73 having a pair of spaced deflectable barbed heads. The light control covering, for example, is mounted on the arm 44 by attaching one hanger 50 to the front sheer, on its inside face precisely at the glue joint formed between a vane and the front sheer. The other hanger 50, at the other end of arm 44 is attached to the inside face of the rear sheer at a point displaced from the glue joint for the same vane in the direction toward the front sheer attachment for that vane. The top inside edge of the front and rear sheers can be provided with a reinforcing strip 74 so pin 73 can clamp the top edge of the sheers to hangers as shown in FIG. 3.

Figure 9:
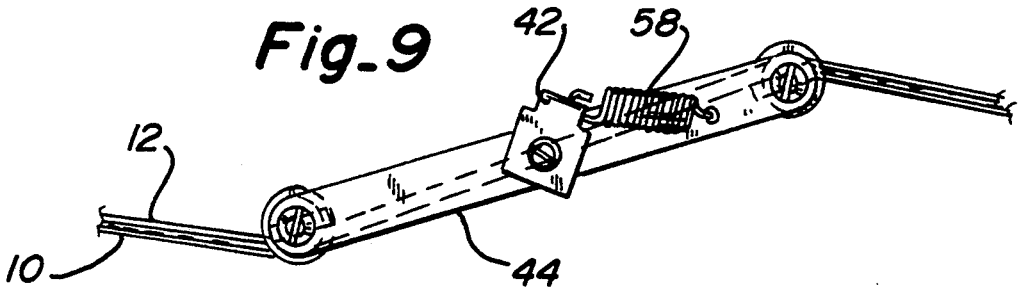
FIG. 9 is a schematic top plan view showing the over-closed position in enlarged detail.
Figure 5:
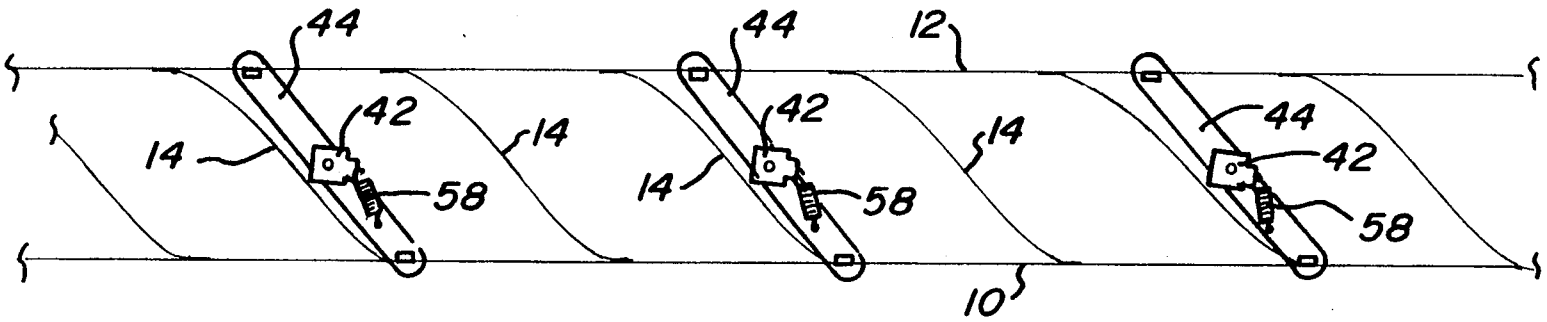
FIG. 5 is a schematic top plan view showing the fabric assembly open and where the actuator arm-hanger subassembly is attached to the sheers.
Figure 6:
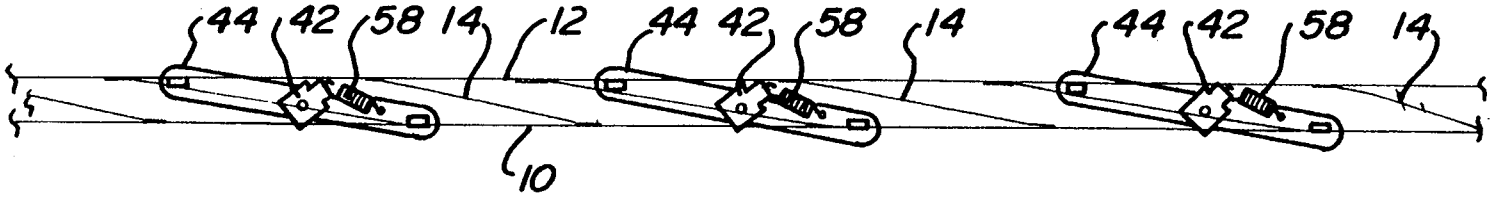
FIG. 6 is a schematic top plan view showing the fabric assembly nearly closed.
Figure 7:
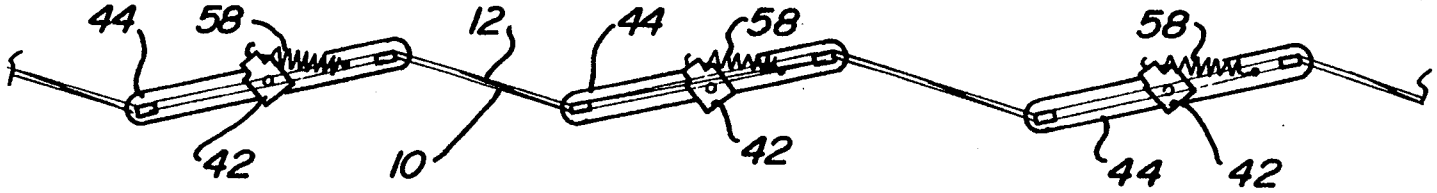
FIG. 7 is a schematic top plan view showing the fabric assembly over-closed.

The light control covering is mounted over an opening with its vanes extending vertically. Actuator arms 44 of the respective carriers 20 are preferably attached to the covering for every other vane as shown in FIG. 5, which shows the covering fully extended over a window or other opening and in the open position (max. light passage). To move the covering to the closed position as shown in FIG. 6, the tilt rod is rotated, driving each worm 32, worm gear 30, shaft 40 and rotating each actuator 42 which in turn, through spring 58, carries arm 44 around shaft 40 bringing the covering to its closed position. At this time, since there is little resistance to rotation of arm 44, spring 58 is not substantially extended or loaded. This condition continues as the covering approaches the closed condition shown in FIG. 6 and proceeds through the closed condition to an over-closed position shown in FIG. 9. The net effect will be slight overtravel of the closed position with the panels (a vane sandwiched between front and rear sheers) now slightly tilted out of the plane of the normally closed plane. Then the resistance to further rotation of the arms 44 caused by the fabric layers having closed on one another becomes greater than the force of the springs 58. Thus, continued rotation of actuators 42 extends and tensions the springs until the actuators 42 engage arm 44 as shown in FIG. 7.

Figure 8:
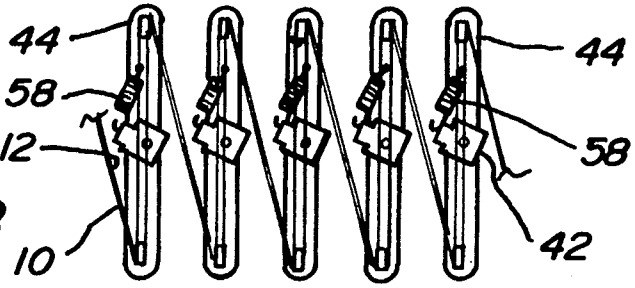
FIG. 8 is a schematic top plan view showing the fabric assembly collapsed.

When the extension of the covering in the over-closed position (full extension of carriers 20) is relieved, as the covering is drawn to the retracted position (gathering of carriers 20 at one end) and retracted from covering the opening (window, door and the like), successively, the pressure on arms 44 exerted by the extended fabric is released and the springs 58 will draw the arms 44 around to the substantially parallel positions shown in FIG. 8 and cause successive panels to collapse and fold upon themselves in substantially parallel folds.

Where the fabric itself or spacers define the distance between adjacent carriers when the light control window covering is in its expanded condition, the carriers are not all moved at the same time to the retracted position of the light control window covering. A first carrier is moved towards an adjacent second carrier by means of a cord, spindle or the like. When the first and second carriers abut, the first carrier moves the second carrier towards the next carrier adjacent to the second carrier, etc. The panels of the already abutting carriers will be folded upon themselves whereby the remaining panels will still be in the slightly overclosed position. Consequently, the panels are successively collapsed and fold upon themselves.

Where a scissor arrangement is used, all carriers are moved to the retracted or stacked position at the same time. Again, the movement is initiated by a cord, spindle or the like which acts on a first carrier whereby the scissor arrangement will cause the other carriers to move upon movement of the first carrier. Consequently, all of the panels will gradually collapse and fold upon themselves at the same time.

It will be clear that the hangers may be directly coupled to the vanes as well. In this case, the vanes, which are directly tilted by the hangers, should be sufficiently stiff to operate the window covering from its open towards its closed and collapsed condition. The principle, however, remains the same.

The springs 58 store rotational energy in the actuator arms 44 when the sheers have been closed upon themselves and release the stored energy when the covering is retracted across the window opening causing the panels to fold neatly on themselves with the actuator arms 44 all parallel and perpendicular to the track rail 26.

In a preferred embodiment, the actuator arms are 2 15/16" long and the hangers for holding the top edges of the front and rear sheers are 3" wide outside-to-outside or approximately equal to the vane spacing of 3" for $3\frac{1}{2}$" vanes. Because of the S shape or curving of the vanes, the maximum spacing of the front and rear sheers is $2\frac{5}{8}$". Most of the components noted in the above description are injection molded plastic parts. The front fabric is polyester of about one ounce per square yard (from about 0.5–2 ounces per square yard) and is a tulle knit with a diamond pattern. The rear fabric is also polyester of the same weight and is a warp knit with diagonal threads and has an orthogonal pattern. The principal characteristic of the rear fabric is the necessity for stability on the bias or diagonal. The vanes are a woven polyester of a weight of 2 ounces per square yard (about 1–4 ounces per square yard) weight. The vanes are preferably opaque but may be translucent for privacy. A stiffener tape is attached to the inside top edges of the front and rear fabrics to enable reinforcement to be able to hang the fabrics on the hangers depending from the actuator arms. Grommets could be used for this purpose, if desired. Weights (about 15 gr weight) are attached to the bottom edge portions on the inside of every other vane at its front and rear portions directly below the attachment points to the hangers, one 15 gr weight per specified location.

Figure 13:
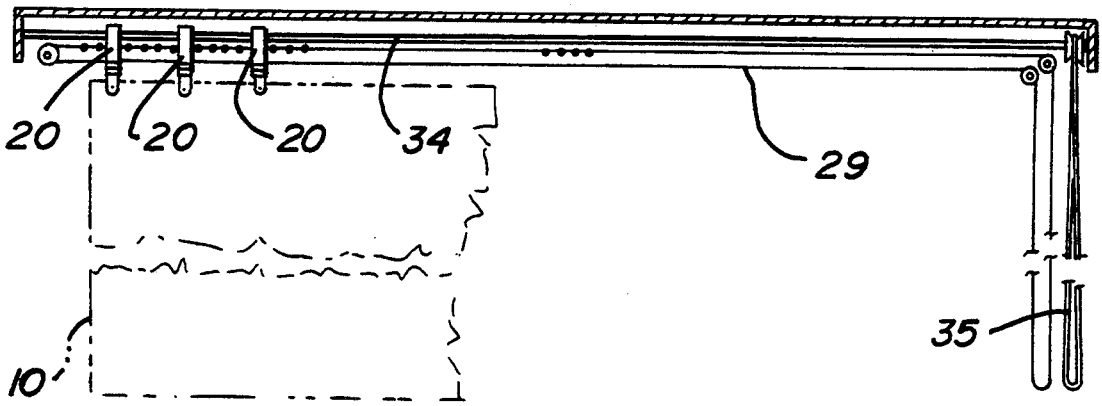
FIG. 13 is a schematic showing cords for moving carriers and a tilt rod.

The tilt rod can be operated by a wand or by one or two pull cords 35 as already known in the art, see FIG. 13. Also, the carriers or carriages are associated with spacers which can be metal strips that fit through slots in the carriers and have stops at each end so the lead carrier can be traversed on the track by a cord arrangement and successively draw out the rest of carriers in appropriate spacing. When retracting the carriers, the lead carrier is drawn back and the strips slip through their slots to allow the carriers to stack at one end. Alternatively a scissors spacer can be used. Both are known and are coupled to the carriers in a known way.

Figure 10:
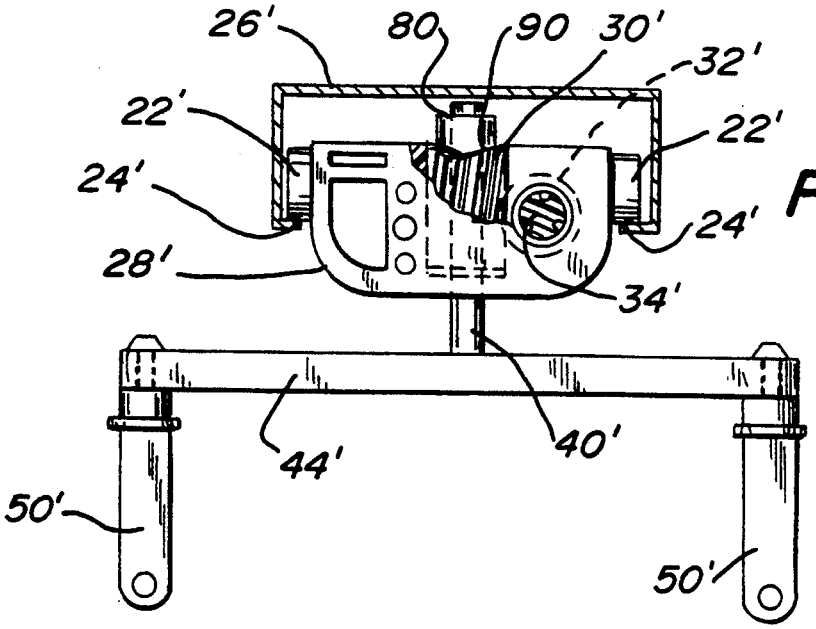
FIG. 10 is an elevational view, part broken away of a modified carrier assembly.
Figure 11:
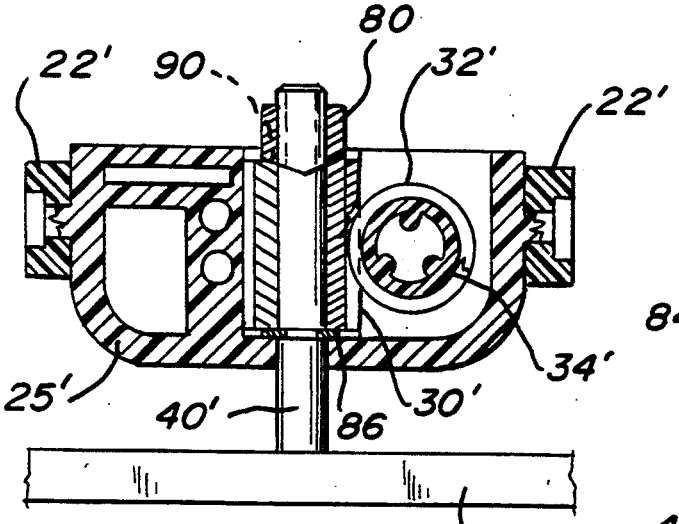
FIG. 11 is a sectional elevational view of the modified assembly.
Figure 12:
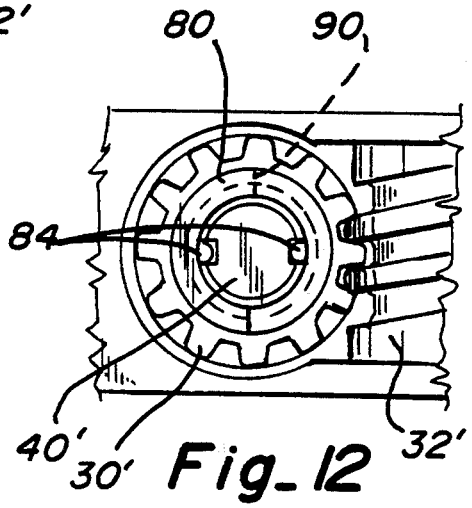
FIG. 12 is an enlarged plan view of the modified assembly.

The carriers can be provided with a slip clutch arrangement to effect over-closing and a tilt toward collapse with a slight force favoring collapse upon relief, or an arrangement as shown in FIGS. 10–12 whereby a resilient force is imposed on the actuator arm 44', such as, by a weight or cam member 80 riding on top of the worm gear 30' and cooperating or coupling therewith via interfitting inclined camming surfaces 90. In this arrangement where like references are used to denote like parts to those in the previous embodiment, the weight 80 is keyed to the shaft 40' which carries actuator arm 44' by keys 84. The worm gear 30' is freely rotatable about shaft 40' and is retained in the carrier body 28' by a snap ring 86 or the like. When the actuator encounters little resistance in moving from the open position shown in FIG. 5 to the closed position shown in FIG. 6, the worm gear drives the actuator through the coupling formed by the interfitting inclined surfaces 90 on the gear 30' and weight 80. Resistance resulting from over-closing, however, will cause the worm gear to drive the weight up the incline out of coupling engagement with gear 30' and store energy in the weight for driving the actuator when the resistance is relieved by the weight dropping back into register with the inclined surface on the worm gear.

With an arrangement of the type shown in FIGS. 10 to 12, retraction of the light control window covering can be stopped (i.e., in an intermediate position) when some but not all of the panels are collapsed and folded over upon themselves. The non-collapsed panels, which are still in the slightly over-closed condition, can then be used to regulate the light through the panels as previously described whereby the already collapsed panels remain in the collapsed position.

Figure 14:
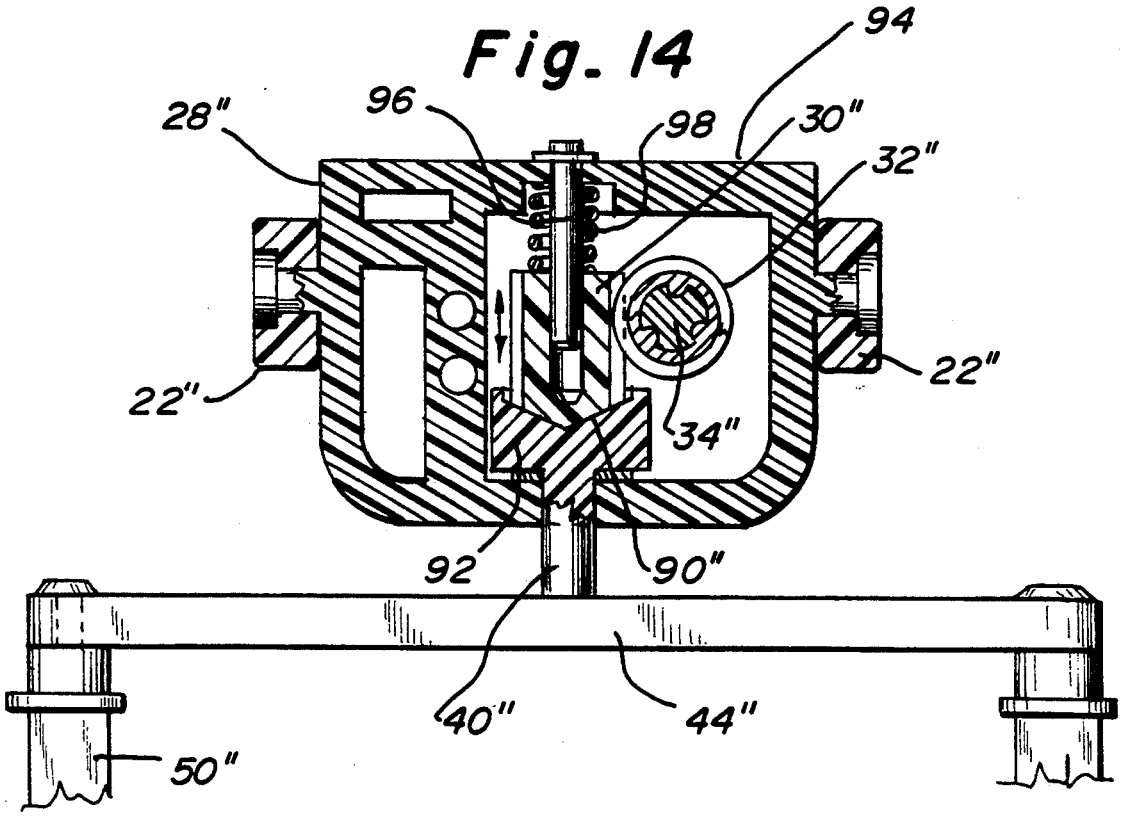
FIG. 14 is a somewhat schematic view of another modified carrier assembly.

In a further modified carrier assembly as shown in FIG. 14, where again like references are used to denote like parts, the actuator 44'' is carried by a shaft 40'' depending from a rotary cam 92 in the carrier body 28'' which in this case has a closed top 94. The worm gear 30'' is mounted above the cam for rotation about a shaft 96 and the worm gear and cam have interfitting inclined camming surfaces 90''. A coil spring 98 may be provided to exert downward pressure on the worm gear.

In this arrangement, when the covering is being closed and there is little resistance to movement of the actuator, the cam and actuator are rotated by the worm gear through the interfitting surfaces 90''. When excessive resistance is encountered, as previously, the worm gear will be lifted against the pressure of spring 98, for energy storage. When the resistance is reduced, the spring pushes the worm down back into engagement with the cam, thereby rotating the cam and actuator. Alternatively, the worm gear itself may comprise a weight for energy storage and the spring can be omitted.

Figure 15:
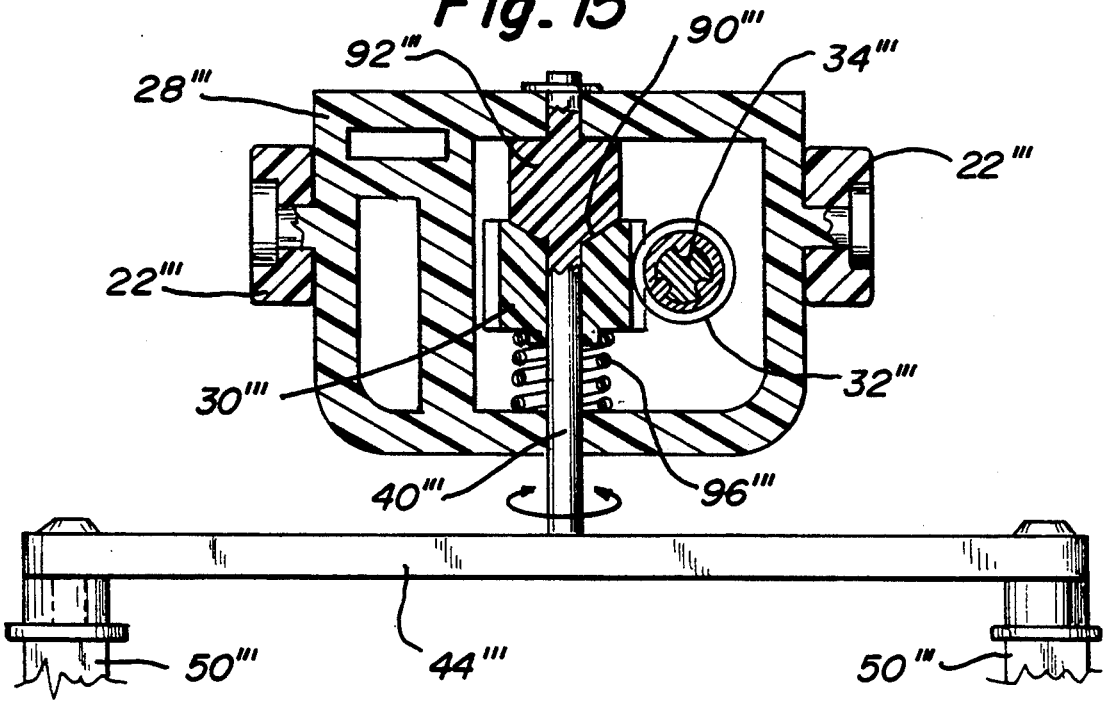
FIG. 15 is a view similar to FIG. 14 of still another modified carrier assembly.

In a still further modified carrier assembly as shown in FIG. 15, the actuator 44''' is carried on a shaft 40''' rotatably mounted in carrier body 28''' and having a cam 92'''at the top of the shaft. The worm gear 30''' is rotatably mounted about the shaft and interfitting V-shaped camming surfaces 90''' are again provided on the worm gear and cam. The worm gear sits on a coil spring 96''' at the base of body 28'''. In this arrangement, when the resistance to rotation of the actuator becomes excessive, the worm gear moves down out of engagement with cam 92''' and when the resistance is decreased the worm gear is sprung back up to reengage the surfaces 90''' and rotate the actuator.

The system for operating the cords, spindle and the like and the system for tilting the hangers may be separated (individual operation) or may be combined in a mono command system (combined operation), which systems are well known in the art. In the latter case, it will be possible to move the carriers and tilt the hangers by operation of one simple wand, cord or the like. Furthermore, the above operation may be actuated by motor drive means which are operable by means of, for example, a remote control unit. Although the invention has been described with reference to specific embodiments, changes are possible which do not depart from the teachings herein. Such are deemed to fall within the purview of the claimed invention.

We claim:

1. A light control covering assembly for an architectural opening comprising in combination:

a) a covering comprising:

i) first and second generally parallel spaced apart, longitudinally extending, sheer fabrics, each having a top edge portion and a bottom edge portion;

ii) a plurality of longitudinally spaced, generally parallel, vertically extending vanes, fixedly secured to said first and second sheer fabrics to extend therebetween; and iii) said fabrics and said vanes defining a series of panels composed of a vane and the associated portions of the fabrics, b) a track, and c) carrier means riding in said track between a spread condition and a stacked condition and being connected to said top edge portions of said panels for extending said panels to a vertically planar orientation in which said covering covers an opening when the carrier means are in the spread condition, and in which spread condition the panels can be manipulated to tilt the vanes between a closed position parallel to said fabrics and an open position generally normal to said fabrics to obtain light control and for imposing a force on said series of panels in the closed position such that when said carrier means are moved from the spread condition toward the stacked condition, the imposed force is relieved and the panels fold up upon themselves.

2. An assembly as claimed in claim 1, wherein each sheer fabric has dimensional stability in substantially mutually perpendicular directions inclined to the vertical.

3. An assembly as claimed in claim 2, wherein one of the sheer fabrics has diamond-shaped interstices and the other sheer fabric has rectangular interstices with inclined loop threads.

4. A light control covering assembly for an architectural opening comprising in combination:

a) a covering comprising:

i) first and second generally parallel spaced apart, longitudinally extending, sheer fabrics, each having a top edge portion and a bottom edge portion;

ii) a plurality of longitudinally spaced, generally parallel, vertically extending vanes, fixedly secured to said first and second sheer fabrics to extend therebetween; and iii) said fabrics and said vanes defining a series of panels composed of a vane and the associated portions of the fabrics, b) a track, and c) carrier means riding in said track between a spread condition and a stacked condition and being connected to said top edge portions of said first and second fabrics panels for extending said panels to a vertically planar orientation in which said covering covers an opening when the carrier means are in the spread condition, and in which spread condition the panels can be manipulated to tilt the vanes between a closed position parallel to said fabrics and an open position generally normal to said fabrics to obtain light control, said carrier means comprising plural carriers spaced along said track, each carrier including an actuator member attached to said panels, a rotary drive mechanism for rotating said actuator member to tilt a respective vane between the open and closed positions and rotational energy storing and release means connected between the drive mechanism and the actuator member for storing rotational energy in the actuator member when the actuator member is arrested by encountering resistance created by said fabrics in the closed position, and for releasing said energy effective to provide additional rotation of the actuator member when said resistance is relieved by movement of the carriers from the spread condition to the stacked condition so as to stack the covering in substantially parallel folds.

5. An assembly as claimed in claim 4, wherein each carrier comprises a carriage mounted for movement along said track wherein said drive mechanism includes a shaft depending from said carriage, drive means on said carriage for rotating the shaft and an actuator control element mounted on said shaft for rotation therewith, wherein said actuator member is rotatably mounted on said shaft and wherein said energy storing and release means comprises a tension spring connected between the actuator control element and the actuator member.

6. An assembly as claimed in claim 5, wherein said actuator control element comprises a generally horizontal leg mounted on the shaft and a generally vertical leg depending from the horizontal leg, the vertical leg being adapted to engage a first portion of the actuator member when the vanes are in the open and closed positions and the spring is in its retracted position, and to engage a second portion of the actuator member to limit said continued rotation of the drive mechanism and provide maximum extension of the spring and energy storage in the actuator member.

7. An assembly as claimed in claim 5, wherein said drive means comprises a worm on said shaft and a worm drive gear for rotating said worm.

8. An assembly as claimed in claim 6, wherein said worm drive gear has a central aperture for a drive shaft and the worm drive gears of all of said carriers are connected for rotation in unison by a common drive shaft in the form of a tilt rod.

9. An assembly as claimed in claim 4, wherein each actuator member includes attachment means securing the actuator member to the first and second fabrics.

10. An assembly as claimed in claim 9, wherein each actuator member includes a pair of depending pivoted hangers attached to the respective fabrics and defining the attachment means.

11. An assembly as claimed in claim 10, wherein each fabric has a reinforcing band extending along the top edge thereof and wherein each hanger is attached to a respective fabric by a pin extending through the fabric, the reinforcing band and the hanger.

12. An assembly as claimed in claim 4, wherein each carrier comprises a carriage mounted for movement along said track, wherein said actuator member is carried on a rotary shaft depending from said carriage, wherein said drive mechanism includes a driven gear rotatably mounted around said shaft, a weight mounted on said shaft over said gear for sliding movement on the shaft and rotation therewith, and wherein said energy storing and release means comprises a slip coupling means between said weight and said gear for coupling the gear and shaft during movement of the vanes between the open and closed positions, for lifting the weight out of coupling engagement with the gear when the actuator is arrested by encountering said resistance and for allowing the weight to fall back into coupling engagement with the gear accompanied by rotation of the shaft and actuator member when said resistance is removed.

13. An assembly as claimed in claim 12, wherein said coupling means comprises interfitting inclined camming surfaces on the weight and gear, respectively.

14. An assembly as claimed in claim 12, wherein said gear comprises a worm gear and the drive means further includes a worm in the carriage for rotating the worm gear.

15. An assembly as claimed in claim 14, wherein the worms of all said carriages are connected for rotation in unison by a common tilt rod.

16. An assembly as claimed in claim 4, wherein each carrier comprises a carriage mounted for movement along said track, a rotary shaft extending from said carriage and connected to said actuator member, a driven gear in said carriage coaxially and rotatably mounted with respect to said shaft, and coupling means defining a releasable energy storing drive connection between said gear and said shaft for driving said shaft and pivoting said actuator member upon driving of said driving gear when the actuator member encounters resistance to rotation below a predetermined value and for uncoupling the gear and shaft and storing energy in the coupling means upon movement of said driving gear relative to the shaft when the actuator member encounters resistance to rotation exceeding said value.

17. An assembly according to claim 16, wherein the coupling means includes a cam member and wherein the cam member and driven gear are provided with mutually interfitting camming surfaces movable out of interfitting engagement for uncoupling the gear and shaft and storing energy in the coupling means.

18. An assembly according to claim 17, wherein the shaft and cam member are fixed axially in the carriage and the driven gear is mounted for axial movement to engage and disengage the camming surfaces.

19. An assembly according to claim 18, including a compression spring for urging the driven gear toward coupling engagement with the cam member.

20. An assembly according to claim 18, wherein the driven gear is mounted above the cam member and urged by gravity toward coupling engagement therewith.

21. An assembly according to claim 20, including a compression spring acting downwardly on the driven gear to provide an additional force urging the driven gear toward coupling engagement with the cam member.

* * * * *